US006423017B2

(12) United States Patent
Brotz

(10) Patent No.: US 6,423,017 B2
(45) Date of Patent: Jul. 23, 2002

(54) THERAPEUTIC STIMULATORY MASSAGE APPARATUS

(76) Inventor: Gregory R. Brotz, P.O. Box 1322, Sheboygan, WI (US) 53081

( * ) Notice: Subject to any disclaimer, the term of this patent is extended or adjusted under 35 U.S.C. 154(b) by 0 days.

(21) Appl. No.: 09/771,830

(22) Filed: Jan. 29, 2001

Related U.S. Application Data

(63) Continuation-in-part of application No. 09/039,521, filed on Mar. 16, 1998, now Pat. No. 6,179,797.

(51) Int. Cl.[7] ..... A61H 19/00
(52) U.S. Cl. ..... 601/151; 601/148; 601/150
(58) Field of Search ..... 601/148, 149, 601/150, 151, 152, 159, 160, 166

(56) References Cited

U.S. PATENT DOCUMENTS 3,977,396 A * 8/1976 Cartier ..... 601/151
4,648,392 A * 3/1987 Cartier et al. ..... 601/151
5,042,479 A * 8/1991 Brotz ..... 4/491
5,540,651 A * 7/1996 Risch et al. ..... 160/392
5,672,148 A * 9/1997 Maunier ..... 601/148
6,027,464 A * 2/2000 Dahlquist ..... 601/148
6,179,797 B1 * 1/2001 Brotz ..... 601/148

* cited by examiner

*Primary Examiner*—Michael A. Brown
*Assistant Examiner*—Benjamin K Koo
(74) *Attorney, Agent, or Firm*—William Nitkin

(57) ABSTRACT

A therapeutic stimulatory massage apparatus for receipt therein of a body portion, such apparatus containing a thixotropic fluid medium subject to selective increase in viscosity and increase in pressure at such areas of increased viscosity. Also, other therapeutic modes can be incorporated into the device of this invention.

7 Claims, 15 Drawing Sheets

THERAPEUTIC STIMULATORY MASSAGE APPARATUS

This application is a continuation-in-part of my previous application entitled Therapeutic Stimulatory Massage Device, Ser. No. 09/039,521 filed Mar. 16, 1998, now U.S. Pat. No. 6,179,797.

BACKGROUND OF THE INVENTION

1. Field of the Invention

The device of this invention relates to therapeutic baths and massage treatment for individuals and more particularly relates to a device with a containment chamber in which an individual or body part is positioned and around which a plurality of body movement and/or therapy means are arrayed with selected therapy modes.

2. Description of the Prior Art

Baths especially designed for treatment of ailments are well known with whirlpool baths being a prime example of such prior art. Other types of therapeutic baths such as bubbling baths, heated baths, and mineral baths are also known in the prior art. It has long been known that people with skin diseases, bums, or muscular ailments will benefit from various therapeutic bathing techniques. For example, whirlpool baths apply pressure to muscles of the body by the various movements of the water. Also massage techniques have been found useful for applying pressure in various ways to muscles of the body. Various techniques in massage therapy, such as effleurage, incorporate light or heavy stroking of the muscle. Petrissage involves a kneading or squeezing action of the muscle. Tapotement incorporates the use of the sides of the hands to strike the body. The pounding impact and various squeezing actions of massage aid in many therapies such as the removal of fluids from muscle tissue and the alleviation of lactic acid buildup.

Brotz, the inventor herein, in U.S. Pat. No. 5,042,479 discloses a therapeutic vibratory bath having a plurality of vibrators disposed on multiple levels. The vibrators are designed to move the bath fluid to provide therapeutic treatment such as for burns, hypertension, circulatory disturbances, etc. There are difficulties, though, in providing localized vibration patterns sufficient to overcome the tendency of fluid pressure to equalize inside a vessel according to Pascal's law.

SUMMARY OF THE INVENTION

It is an object of this invention to provide a therapeutic stimulatory massage device which in one embodiment includes a therapeutic bath for the treatment of a wide variety of conditions such as, but not limited to, burns, hypertension, circulatory disturbances, rheumatic and arthritic conditions, various metabolic diseases, nervous conditions, and fluid buildup in muscles by incorporating various stimulatory methods, mediums and patterns.

It is a further object of this invention to provide a therapeutic massage device which is utilizable by individuals, even by those suffering from debilitating or degenerative muscular disease and which can provide passive muscle exercise and muscle massage to the user.

It is yet a further object of this invention to provide a therapeutic bath having improved stimulating means by use of a plurality of fluid movement means such as piston-cylinders on multilevel parallel arrays. Such fluid movement devices can operate by use of solenoids powered by electricity, electromagnetic power, pneumatic power, hydraulic power, piezoelectric actuators or equivalents.

It is yet still a further object of this invention to provide an improved medium for a therapeutic bath that employs an electrorheologic fluid, magnetorheologic fluid, or dilatant to take advantage of the thixotropic effect of certain fluids to stiffen in consistency under various conditions to improve the effectiveness of the bath.

In one embodiment the basic structure of the bath of this invention allows for a patient or body part to be placed in a fluid medium wherein a pressure wave pattern is set up within the medium around the patient, such pattern selected from a variety of wave patterns, as will be described below, which movement of the medium against the patient helps to treat the specific ailment of the patient.

The basic structure of one embodiment of this invention provides for an inner containment chamber, the wall of which can be formed of resilient material such as rubber. The containment chamber can be formed with an area defined therein for the holding of a fluid medium and also to receive the individual or body part being treated in the bath. The containment chamber can be generally cylindrical in shape, but other shapes will fall within the scope of this invention. The containment chamber can not only be disposed vertically, but also disposed horizontally in some embodiments, if desired. Around the containment chamber, in one embodiment, can be disposed a plurality of piston-cylinder stimulating devices also referred to as stimulators attached in multilevel parallel arrays, each array positioned at a different height or position within the containment chamber and each piston-cylinder designed to operate at a selected frequency and in a selected sequence with one another to provide pressure to the fluid medium in the chamber tailored to the specific needs of the patient. For example, a pressure wave pattern can be structured in a spiraling downward pattern depending upon the sequencing of the stimulators or, for example, a pattern can be produced where all of the stimulators at a particular vertical level operate in unison to create a harmonic pressure wave between the levels of the stimulators. In another example, stimulators located at two diametrically opposing positions around the containment chamber can operate in unison and the stimulator operation could be in a rotational sequence around the major axis of the cylindrical containment chamber to create a spiraling pattern of the fluid medium around the body. There also could be a completely random sequence of operation of the stimulators. In the horizontal or vertical containment chamber embodiment, which is described further below, the pulsation could be peristaltic in nature, for example. The pattern of stimulator operation will be determined by the desired result to be achieved. Some desired results can call for a wave pattern which runs from an upper part of the patient's body to a lower part while other patterns can be utilized for muscular toning wherein one might want patterns to push against a patient's muscles at particular levels within the containment chamber.

The containment chamber wall can, in one embodiment, be made of a rubber-like material that is resilient, but the material of the chamber wall's construction depends upon the amount of movement required and level and frequency of stimulations desired to be employed in the device.

The fluid medium that is placed in the containment chamber can vary in different embodiments of this invention. The device of this invention incorporates the thixotropic effect, which causes the fluid medium to increase in viscosity and stiffen and become resistant to movement when subjected to a pressure wave pattern generated by the piston-cylinders. Such a fluid medium can consist of an electrorheologic fluid, magnetorheologic fluid, or dilatant, depending on the type of stimulation being employed in the particular embodiment, whether it be mechanical or produced by an electric current or magnetic means.

In some cases, it is desirable to protect a patient's skin from the fluid medium or shield it from electrical current or a magnetic field. In such cases, the limb ordinarily directly exposed to the fluid medium within the containment chamber can be covered with a glove or covering. If desired, electrodes can be extended through the glove or covering and placed in direct contact with the skin, providing electrical muscle stimulation. A sealer can be used to prevent leakage of the fluid medium into the body portion receiving area of the containment chamber protected by the glove or covering. In some instances, though, such magnetic shielding would not be utilized such as for magnetotherapy treatments.

DESCRIPTION OF THE PREFERRED EMBODIMENT(S)

Figure 1:
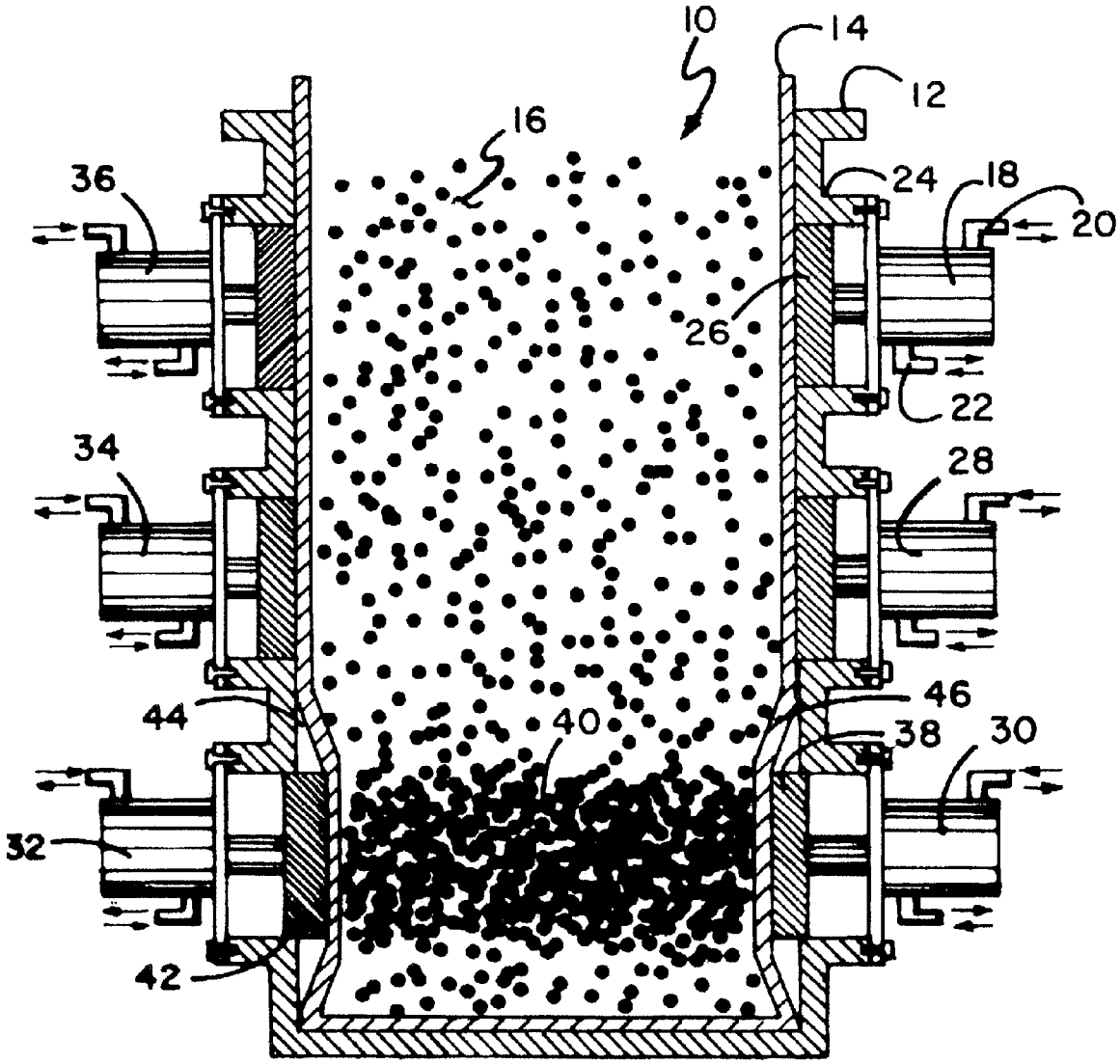
FIG. 1 illustrates a cross-sectional side view of the containment chamber of this invention showing the chamber with a plurality of piston-cylinders and a horizontally disposed zone of increased viscosity in the lower level of the chamber.
Figure 3:
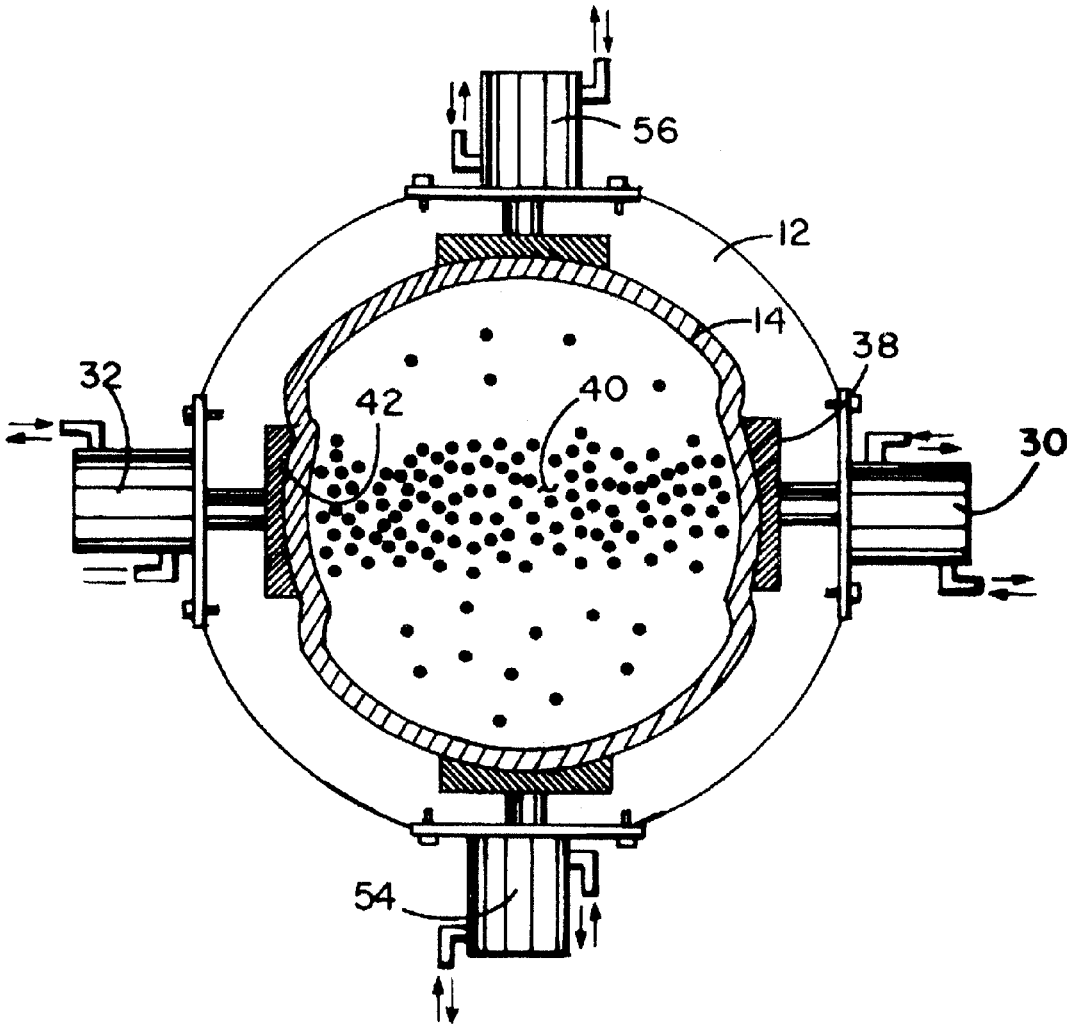
FIG. 3 illustrates a top view through a cross-section of the lower level of the containment chamber of FIG. 1.

FIG. 1 illustrates a side view of one embodiment of the device of this invention showing containment chamber 10 in which a patient or portion thereof is to be positioned. Containment chamber 10 can be generally cylindrical in shape and surrounded by a plurality of linear actuators such as cylinders 18, 28, 30, 32, 34, and 36 which, in combination of one or more, move inward to provide stimulating means by forming pressure wave patterns. Containment chamber 10 is filled with a medium 16, which when pressurized provides a therapeutic treatment to the body parts immersed therein. Medium 16 can be an electrorheologic fluid, magnetorheologic fluid, dilatant, or equivalent which, when pressurized or otherwise activated, produces a thixotropic effect. A thixotropic effect is desirable to enhance and prolong the therapeutic effect created by one or more piston-cylinders pressurizing specific localized areas or zones around a body part. Also, the increase in viscosity, once the medium is activated, increases the pressure directed to a desired body area. A thixotropic medium increases in viscosity, stiffens and becomes resistant to movement when pressurized, resulting in a more concentrated treatment to a particular body area. The same increase in viscosity occurs in electrorheologic fluid, magnetorheologic fluid, or dilatant when activated to stiffen. The cylinders are attached to outer casing 12, a rigid framework which surrounds and supports containment chamber 10. The cylinders are arranged in multilevel arrays and positioned all around containment chamber 10. Each of the plurality of pistons interacts with its respective cylinder, such as piston 24 which moves in and out of cylinder 18, providing mechanical means for pressurizing medium 16. A discussion of cylinder 18 follows, and it should be noted that this cylinder is similar in construction and operation to all the other cylinders. Cylinder 18 contains intake valve 20 and exhaust valve 22 which can be positioned in various places on cylinder 18 depending on the type of piston-cylinder utilized. The piston-cylinder combination can be hydraulic, pneumatic, piezoelectric, memory metal actuators designed to protrude inward, or use other motive forces useful for imparting stimulation within the device of this invention. Piston 24 is attached to flow-actuating block 26 which imparts movement to containment chamber wall 14, pushing inward and pressurizing an area within containment chamber 10. Containment chamber wall 14 can be formed of a resilient material such as rubber, as the material should be sufficiently flexible to allow block 26 to impart movement to medium 16. The piston-cylinder arrangement formed by piston 24, cylinder 18, and block 26 is typical of the type of stimulatory means positioned all around containment chamber 10. As seen in FIG. 1, a horizontal elevated pressure zone 40 can be generated, such as between cylinders 30 and 32. The movement of the piston in cylinder 30 results in the extension of flow-actuating block 38. The expansion in cylinder 32 similarly extends flow-actuating block 42. The inward movement in blocks 38 and 42 causes an inward protrusion of containment chamber wall 14. The result of inwardly projecting wall areas 44 and 46 is a horizontal elevated pressure zone 40 being created between cylinders 30 and 32. This action would provide a therapeutic effect to a specific area of a body part immersed in horizontal elevated pressure zone 40. FIG. 3 illustrates a top view of the horizontal elevated pressure zone between cylinders 30 and 32. Seen in this view are flow-actuating blocks 38 and 42 which cause distortions in the shape of containment chamber wall 14 due to the wall's inward protrusion. Also seen in this view are adjacent cylinders 54 and 56, not seen in FIG. 1, which are not being activated.

Figure 2:
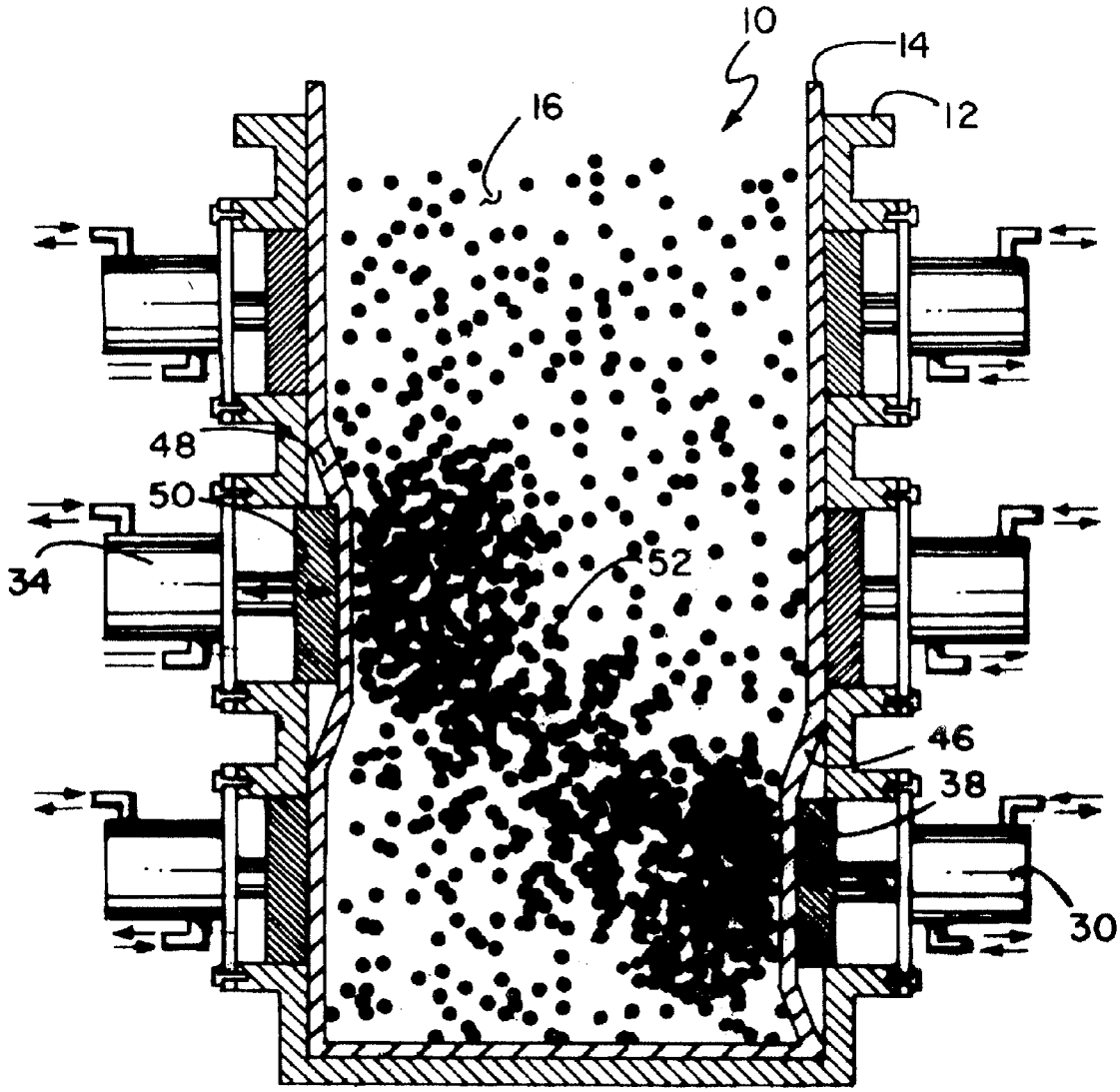
FIG. 2 illustrates a cross-sectional side view of the containment chamber with a diagonally disposed zone of increased viscosity.

As seen in FIG. 2, a zone of increased viscosity can be created between any two cylinders. FIG. 2 illustrates a diagonal elevated pressure zone 52. Stimulations generated by cylinders 30 and 34 cause their respective extended flow-actuating blocks 38 and 50 to bend containment chamber wall 14 at their respective inwardly projecting wall areas 46 and 48, resulting in a diagonal elevated pressure zone 52. Where a plurality of cylinders are employed, negative pressures can be achieved when the cylinders are not being activated or by such cylinder being moved outward, creating more area within the chamber, thus reducing pressure on the medium. Pressure blocks are attached or affixed to chamber wall 14 and move out faster than the flexible chamber wall's natural rebound rate. Such negative pressures are desirable in certain situations such as in treating an individual who has poor circulation where negative pressure will assist in blood flow to the body surface and extremities.

Figure 4:
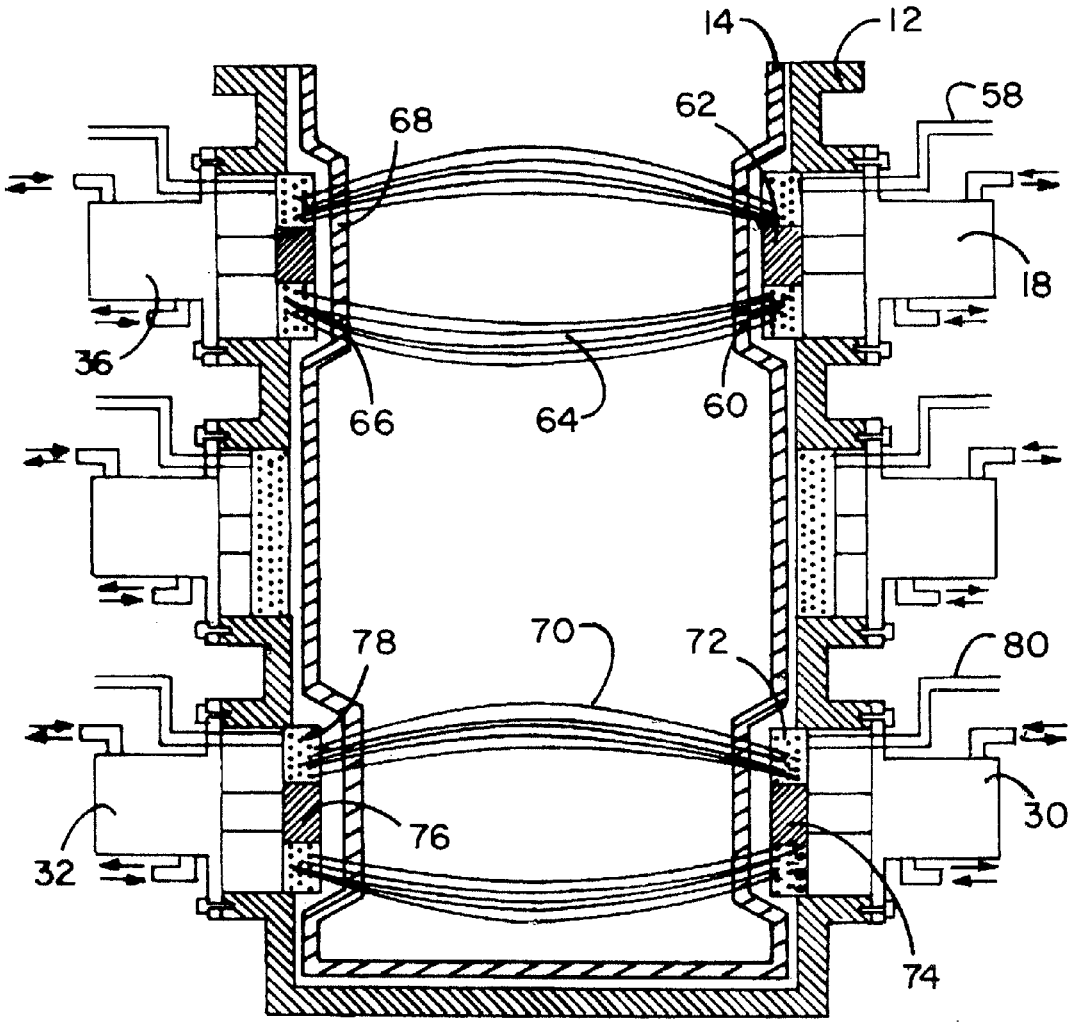
FIG. 4 illustrates a cross-sectional side view of the containment chamber with magnets and magnetic field lines shown in the upper and lower levels.
Figure 5:
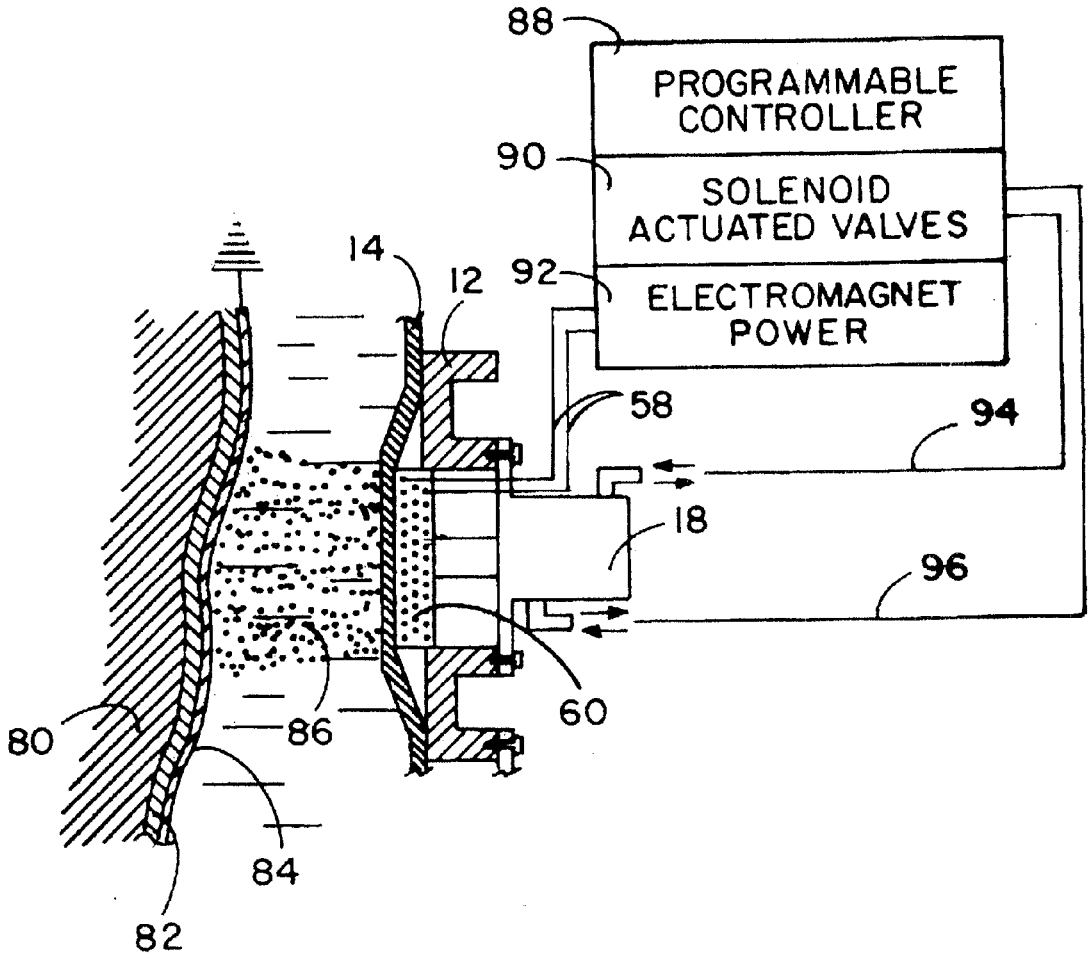
FIG. 5 illustrates an enlarged view of a limb encased by a covering and a zone of increased viscosity near one piston-cylinder.
Figure 6:
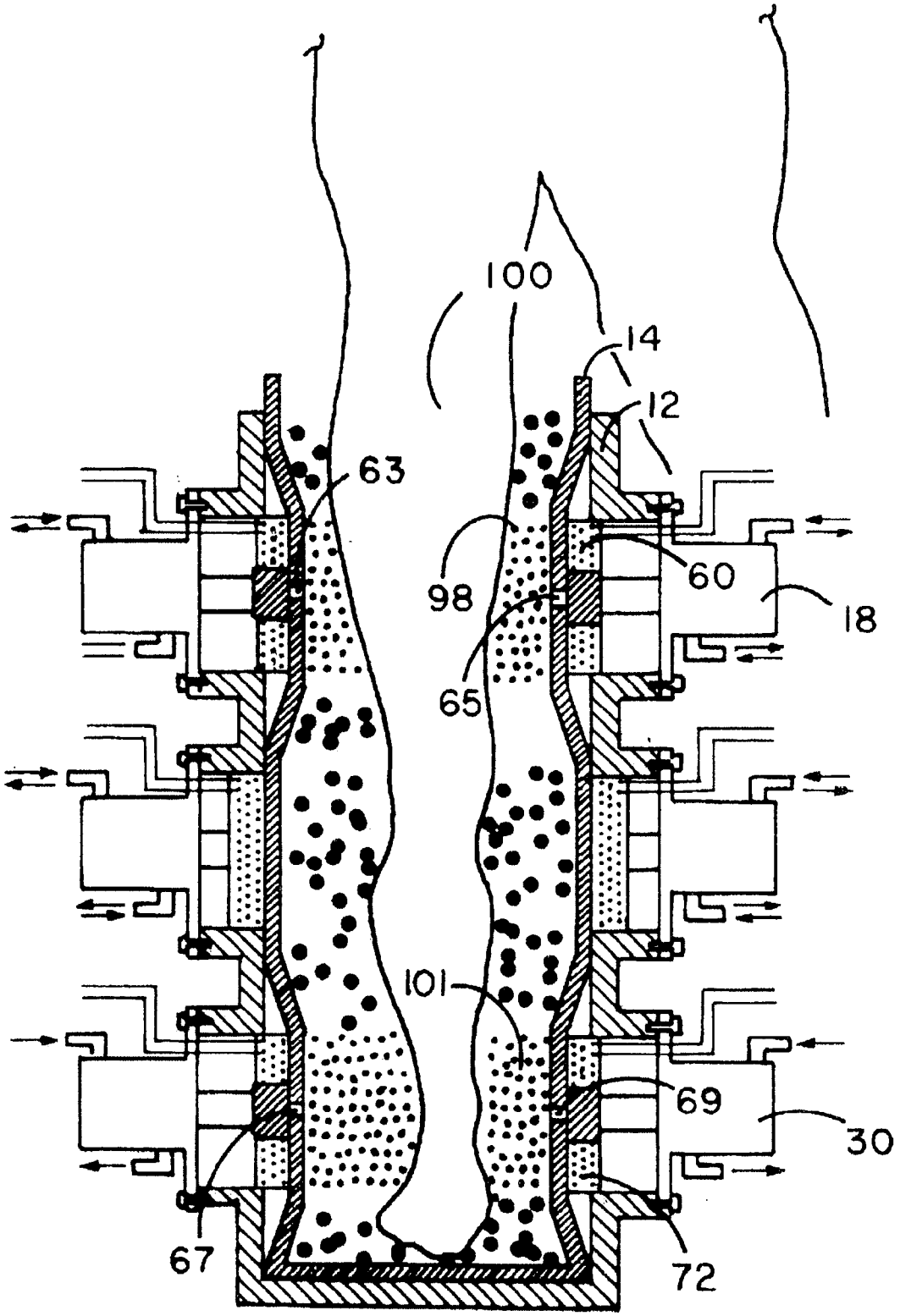
FIG. 6 illustrates a cross-sectional side view of the containment chamber with a patient's leg immersed in the fluid medium.

FIG. 4 illustrates another embodiment of this invention in which the flow-actuating blocks contain magnetic field-producing elements such as coils. Seen in this view are upper level magnetic field lines 64 and lower level magnetic field lines 70 where the fluid medium stimulating means are magnetic fields produced between the coil windings around or inside the flow-actuating blocks of cylinders 18 and 36 in the upper level and cylinders 30 and 32 in the lower level. FIG. 5 illustrates an enlarged view of the stimulations produced by cylinder 18 which operation is similar to the operation of the other cylinders. Coil windings 60 are located in the flow-actuating block. Power lines 58 supply power from electric power source 92, running a current through coil windings 60. Solenoid actuated valves 90 are connected to hydraulic fluid lines 94 and 96, which solenoid valves control movement of the pistons of cylinder 18. The resulting treatment in elevated pressure zone 86 is a result of the combination of the movement of the piston-cylinder and the created magnetized field controlled by programmable controller 88 which magnetic field increases the viscosity of the electrorheological fluid used in this bath. As seen in FIG. 4, a magnetic field is produced from coil 62, and magnetic field lines 64 extend between the coils, such as coils 62 and 68, from electrical currents provided to the coils around the pistons of cylinders 18 and 36, respectively. Magnetorheologic fluid responds to +−, ++, or −− magnetic fields. FIG. 6 illustrates leg 100 of a patient placed in upper level elevated pressure zone 98 and lower level elevated pressure zone 101. Leg 100 can receive therapeutic treatment in the specific zones shown in FIG. 6 as a result of the magnetic fields created between the activated magnetic field coils. At the time the pistons start to extend, the magnetic field is switched on, causing the electrorheological fluid to increase in viscosity to a thick paste-like state and thus produce a pressure zone when the pistons extend on the local area of the body. As the pistons are retracted, the current to the electromagnetic coils can be switched off and then non-viscous fluid moves in to fill the volume left by the retracting chamber wall which occurrence is an example of positive pressure treatment. In some embodiments electrodes, such as electrodes 63 and 65, can be located at the chamber wall to direct an electric current therebetween to increase the viscosity of the fluid medium and in some cases to act as therapeutic treatment. Ultrasound transducers 67 and 69 can also be placed on the chamber wall for therapeutic treatments.

FIG. 5 also illustrates an embodiment of the device using an elevated pressure zone 86, the pressure of which is being imparted to limb 80, which limb can be encased in covering 82 covered by metal coating 84. Covering a body part during treatment may be desirable in situations where direct contact with the medium could cause harm to the patient. In this embodiment, the patient can be shielded from any electromagnetic field or electric current in elevated pressure zone 86. Metal coating 84 can be made of metalized Mylar film or equivalent and is grounded to help prevent shock to the patient.

Figure 7:
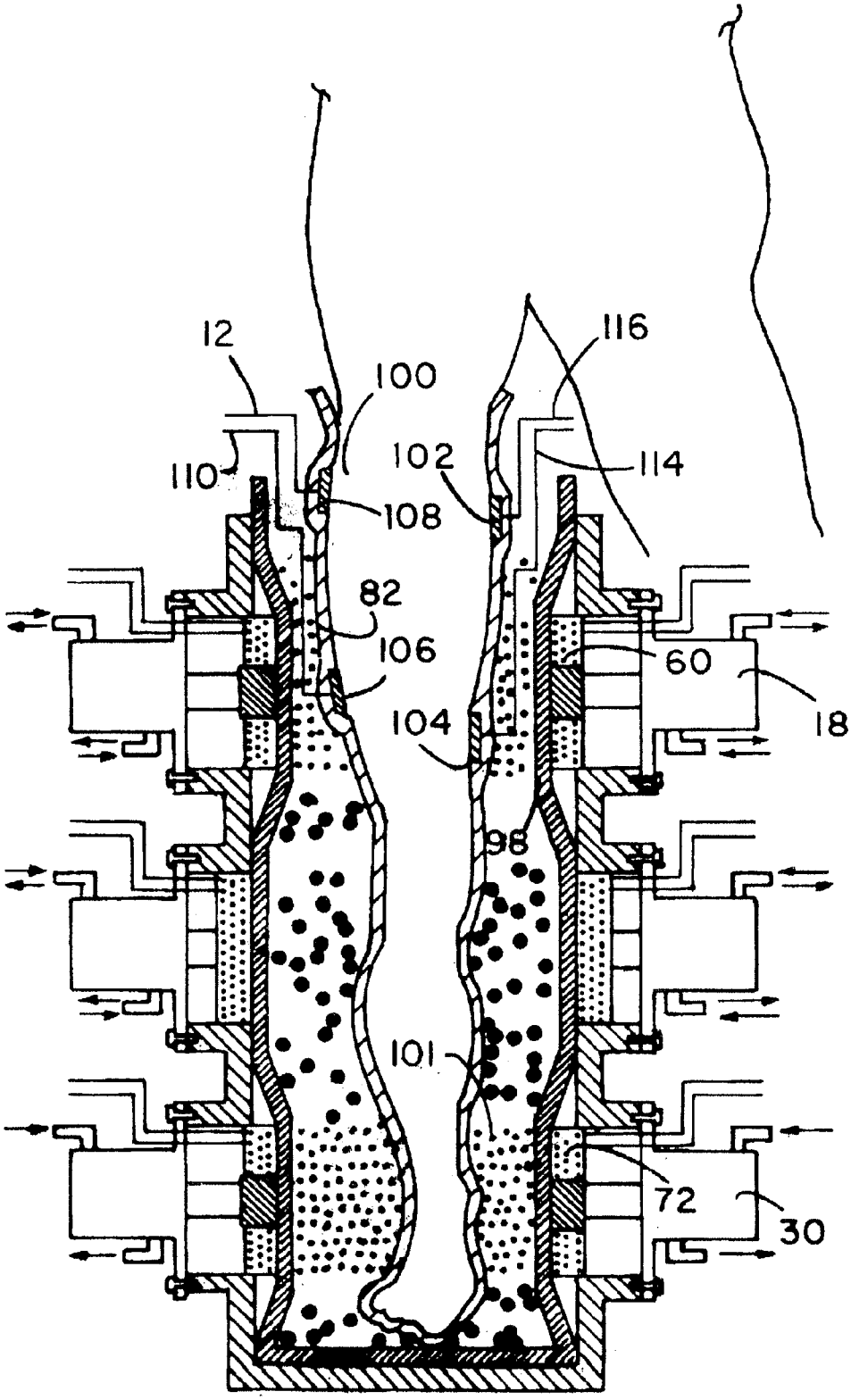
FIG. 7 illustrates a cross-sectional side view of the containment chamber with a patient's leg covered by a covering, such leg immersed in the fluid medium.
Figure 8:
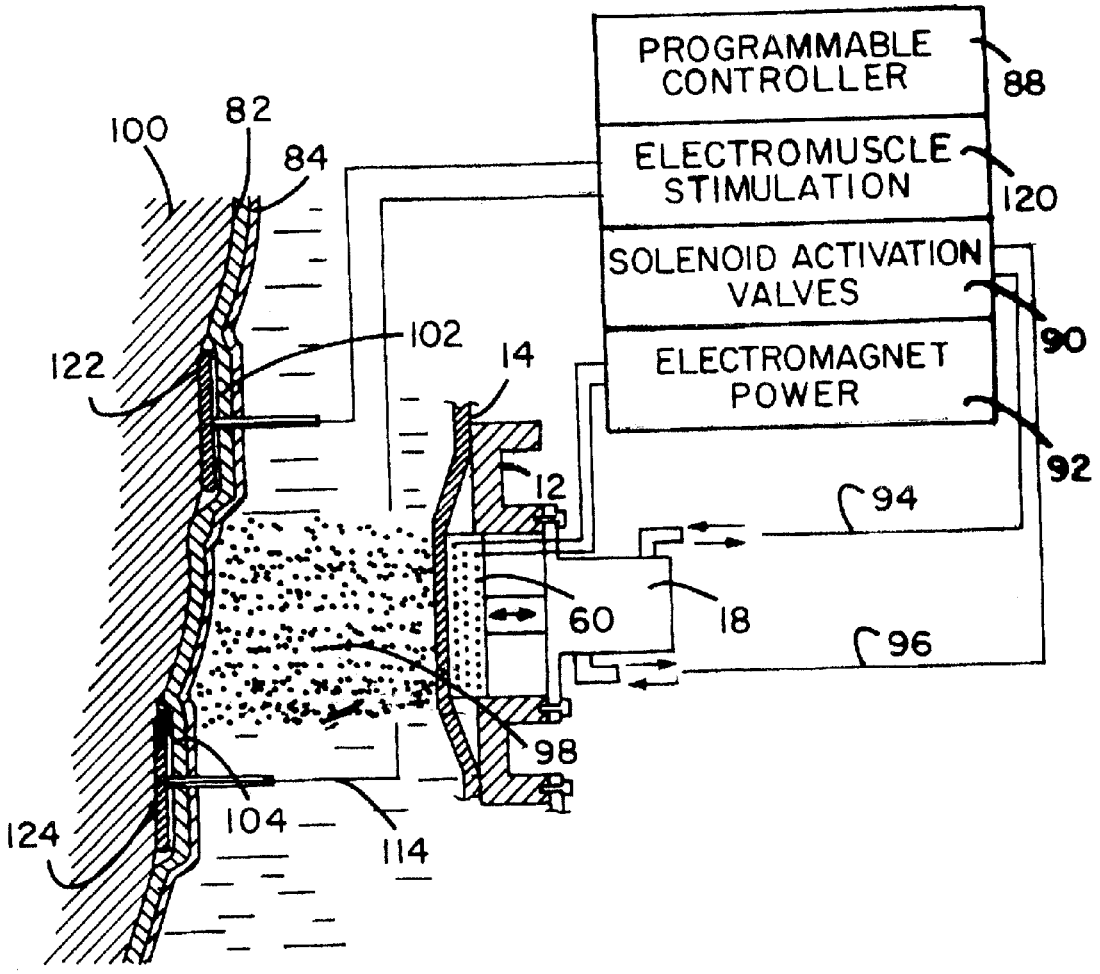
FIG. 8 illustrates an enlarged view of a portion of the patient's limb covered by a covering with electrodes placed through the covering and an elevated zone of increased viscosity near one piston-cylinder and electrodes.
Figure 9:
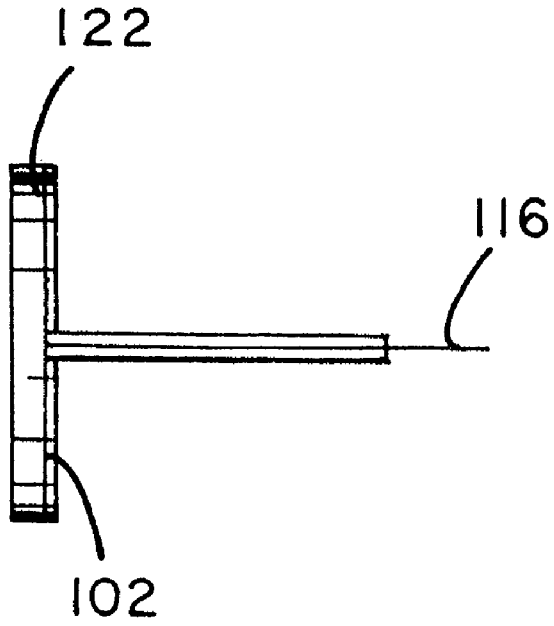
FIG. 9 illustrates a cross-sectional side view of an electrode with conductor lead.
Figure 10:
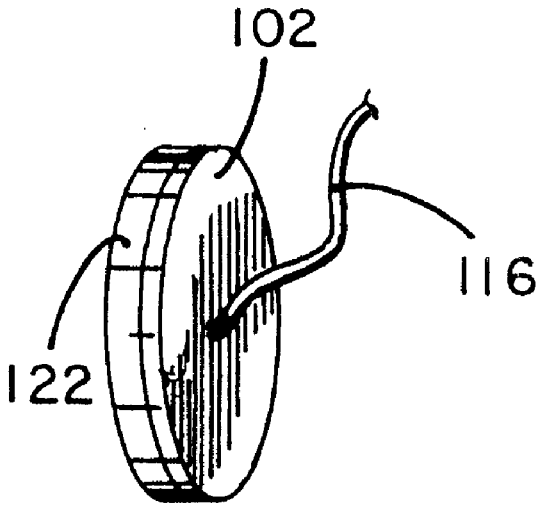
FIG. 10 illustrates a perspective view of an electrode with probe attachment.

One embodiment utilizing covering 82 employs electrodes that pierce the covering surface and make direct contact with the patient's skin for providing muscle stimulation. FIG. 7 illustrates a leg 100 encased by covering 82 immersed in the containment chamber. Electrical lines 110, 112, 114, and 116 pierce through covering 82, and the holes are plugged, respectively, by sealers 106, 108, 104, and 102, protecting leg 100 from exposure to the medium. FIG. 8 illustrates an enlarged view of cylinder 18 with electrodes 122 and 124 making contact with a patient's limb 100. Electrical lines 114 and 116 pierce metal coating 84 and covering 82, the resulting holes being plugged, respectively, by sealers 104 and 102. Electromuscle stimulator 120 controls the action of electrodes 122 and 124. Also seen in FIG. 8 is elevated pressure zone 98 created by the magnetic field emanating from coils 60 in cylinder 18, the entire sequence controlled by programmable controller 88. FIGS. 9 and 10 illustrate enlarged views of electrode 122 with electrical line 116 and sealer 102. Sealer 102 initially has a release paper or film to peel off to expose a high tact adhesive which adheres electrode 122 to covering 82.

Figure 11:
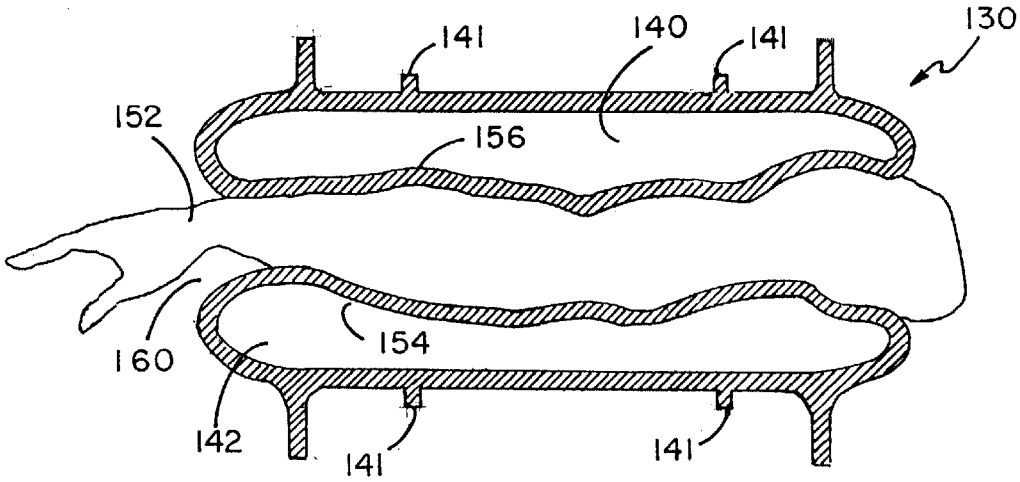
FIG. 11 illustrates a cross-sectional view of a horizontally disposed containment chamber without showing its outer shell.
Figure 12:
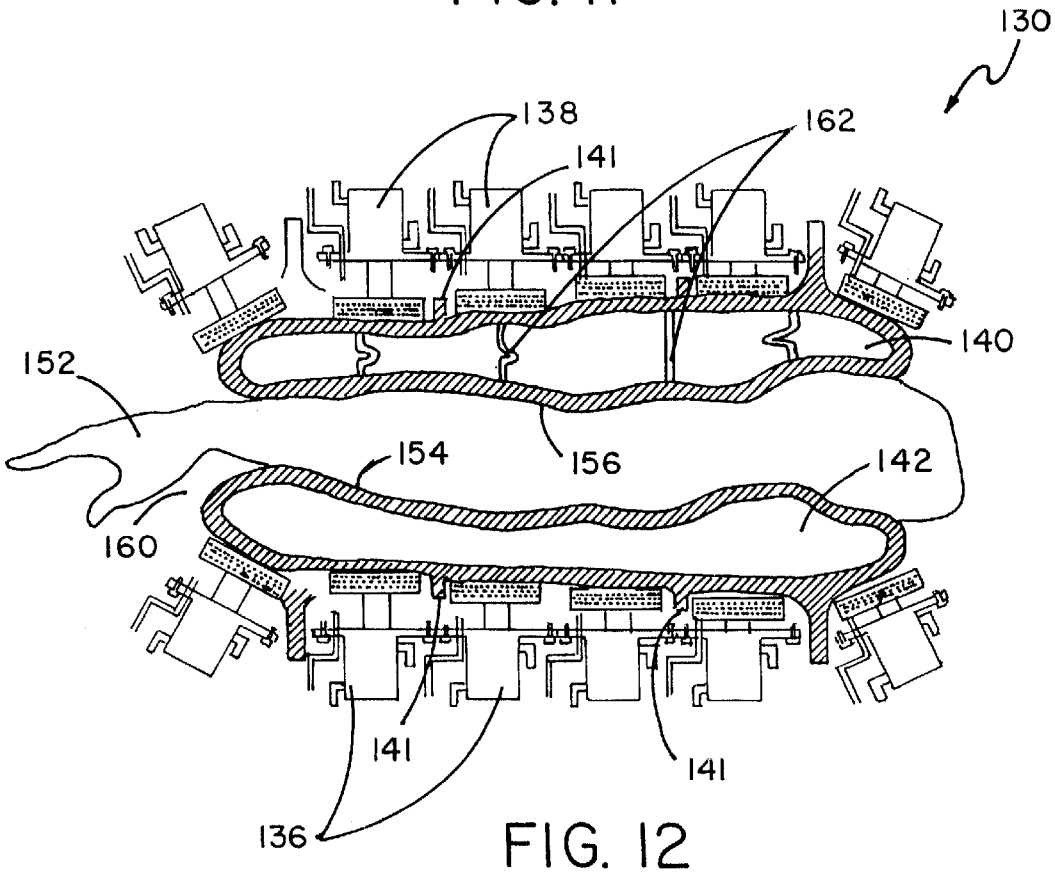
FIG. 12 illustrates a cross-sectional side view of a horizontally disposed containment chamber with piston cylinders disposed therearound and with baffles disposed within the upper bladder of the containment chamber.

The device of this invention can also be horizontally disposed as illustrated in FIGS. 11 and 12. Instead of the body part being encased in a glove or covering, a horizontal massage device 130 can be formed between an upper bladder member 156 and a lower bladder member 154 which act as a covering in the aforementioned embodiment to contain the medium and prevent its escape, each bladder held within an openable outer shell not shown in these views. The outer portions of the bladders act as the chamber wall. Because the sealed bladder members contain the medium and prevent leakage, the device of this invention can be utilized at different angles and for different purposes than possible with the vertically disposed bath of this invention where the medium is open to the environment. Although the massage device is illustrated of a size to accommodate one limb of an individual, the device does not have to be cylindrical in configuration but can also be similar to two large water beds that face one another in which the full body of an individual could fit for full-body massage.

FIG. 11 illustrates a cross-sectional view of horizontal massage device 130 showing an arm 152 surrounded by upper bladder member 156 and lower bladder member 154. The upper bladder has upper bladder hollow interior 140 and the lower bladder member has lower bladder hollow interior 142. Each bladder member can be filled with a medium of the types as disclosed above. Arm 152 is surrounded by the flexible sides of the bladders. Disposed in this embodiment around the upper and lower bladder members are ultrasonic transducers 141 discussed below. The hand of arm 152 extends out opening 160.

FIG. 12 illustrates the massage device of FIG. 11, showing a plurality of cylinders 138 and 136 which surround, respectively, the upper and lower sections of the horizontal massage device in contact, respectively, with upper and lower bladders 156 and 154 and plurality of ultrasonic transducers 141. Baffles or cords 162 help hold the inner portion of upper bladder member 156 from hanging downward too far in order to help keep its general shape when the outer shell is opened. It should be noted that in one embodiment the ultrasonic transducers can be positioned inside the bladder.

Figure 13:
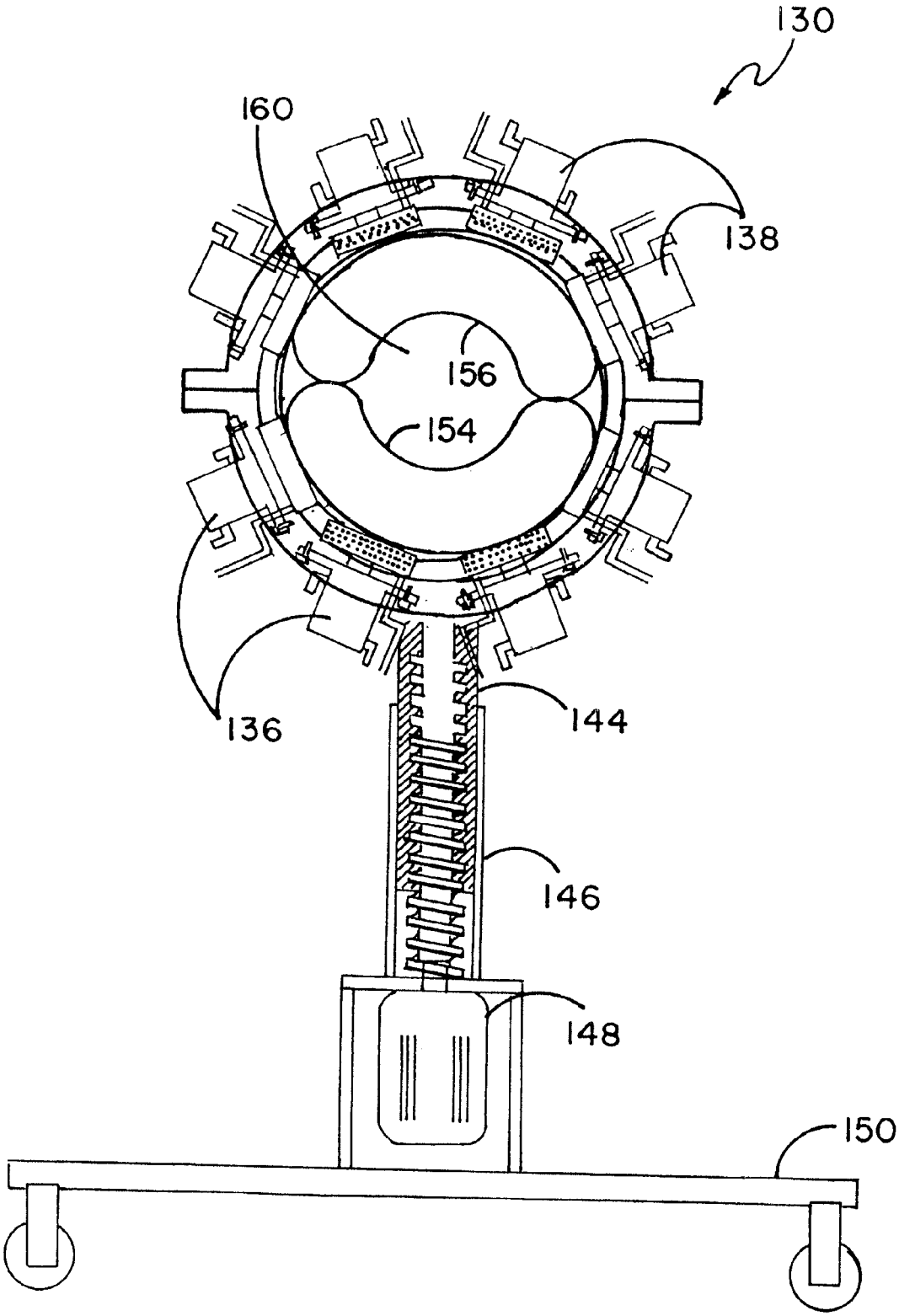
FIG. 13 illustrates an cross-sectional end view of the containment chamber of FIG. 12, showing height-adjusting structure.

FIG. 13 illustrates a cross-sectional end view of the horizontal chamber of FIG. 12 showing opening 160 with upper bladder member 156 and lower bladder member 154 seen in their general positions without any body part in place. First and second groups of piston cylinders 138 and 136 are seen disposed, respectively, around the upper and lower bladders. The horizontal chamber is disposed on a movable platform 150 with wheels so that it can be easily moved to a patient. The container can have height-adjusting structure such as rotating helical members 146 which are rotated as directed by motor 148 in one direction or the other to cause a raising or lowering within the engaging threads in post 144 which supports the chamber. The chamber can be disposed at various angles if the attachments of the posts to the chamber are hinged or are ball joints.

Figure 14:
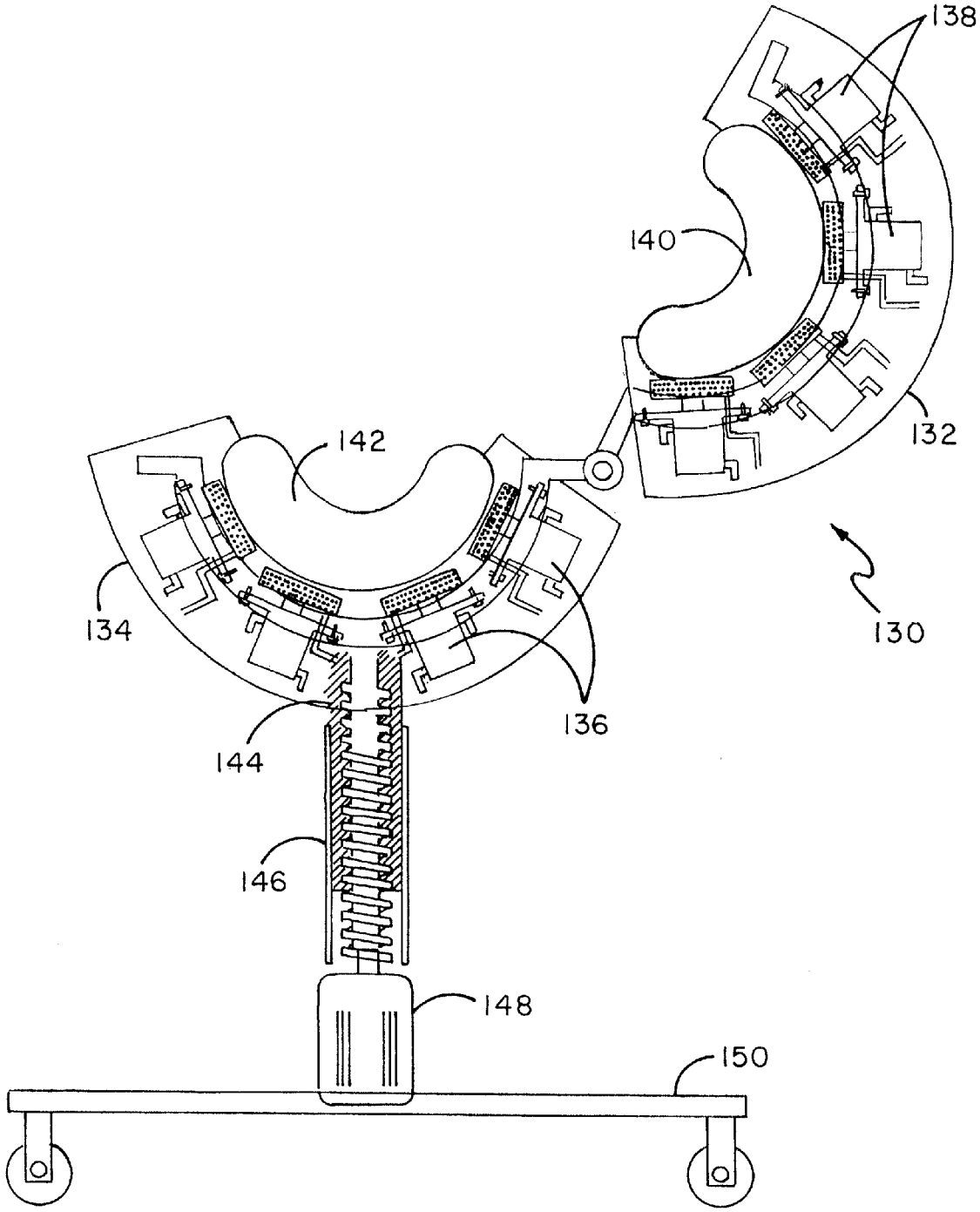
FIG. 14 illustrates the containment chamber of FIG. 13 in an open mode, showing its outer shell.

FIG. 14 illustrates the chamber opened with its upper and lower outer container shells 132 and 134 seen. Opening the container allows easy entry of the body part to be treated therein.

Figure 15:
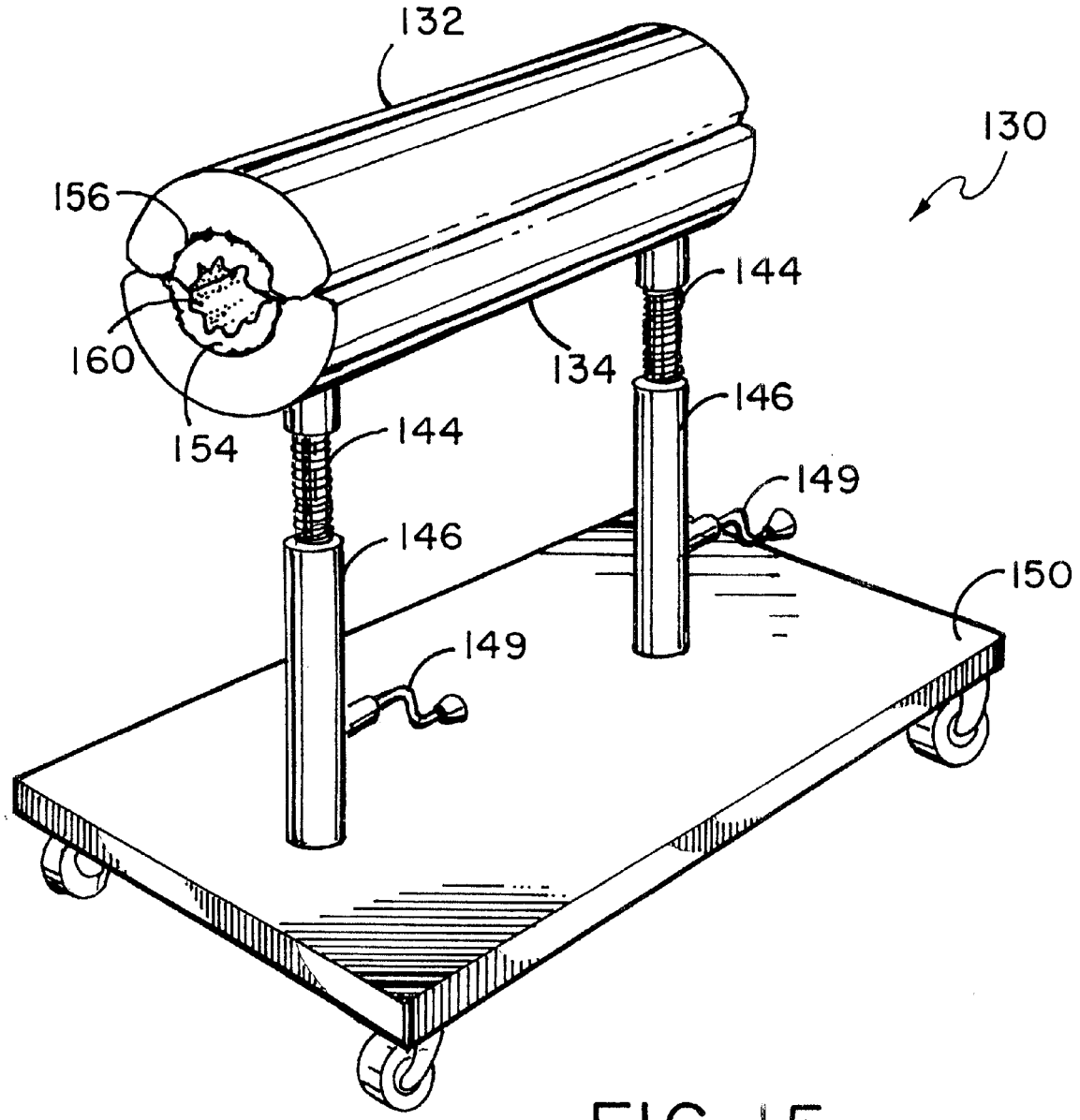
FIG. 15 illustrates a perspective view of the containment chamber of FIG. 14 in a closed mode.

FIG. 15 illustrates a perspective view of the horizontal chamber showing an alternate embodiment with manual height-adjustment cranks 149 to raise or lower post 144 and ball joints, as desired, once the bath has been moved into a desired position next to the patient.

Figure 16:
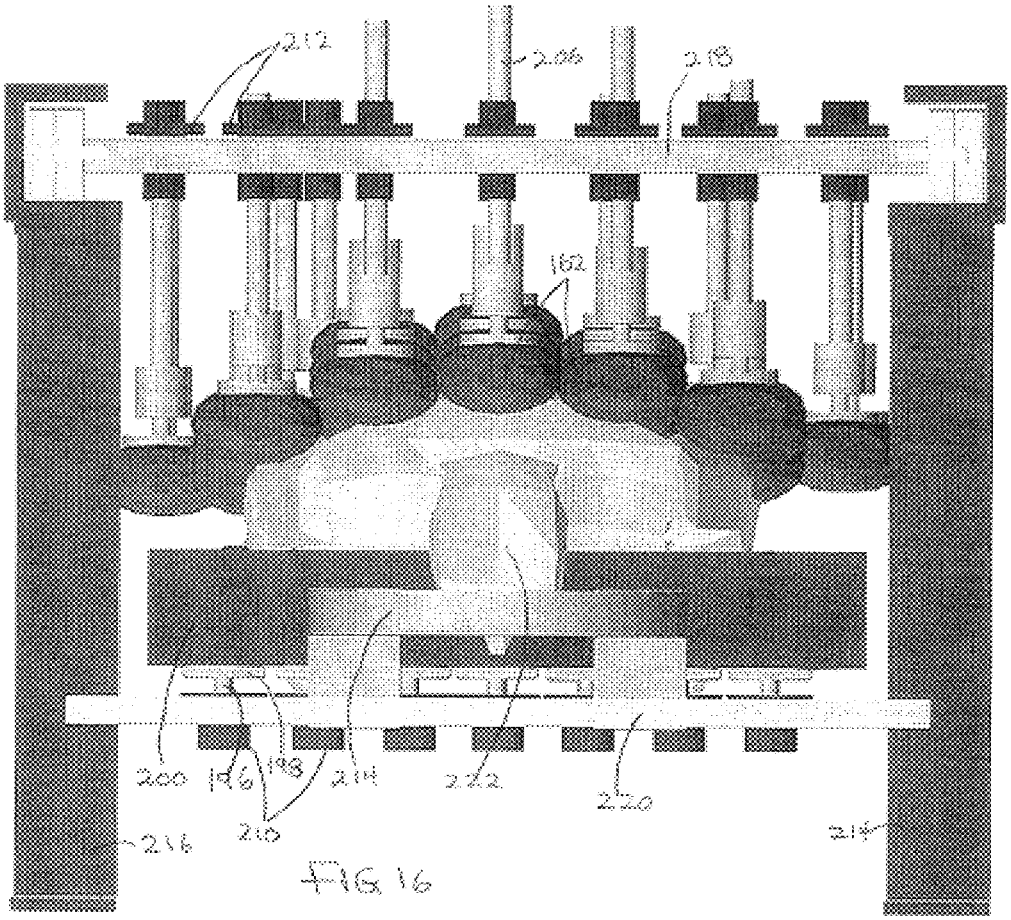
FIG. 16 illustrates a side elevational view of a containment apparatus utilizing multiple upper bladders and a single lower bladder with a plurality of horizontally disposed piston cylinders.
Figure 17:
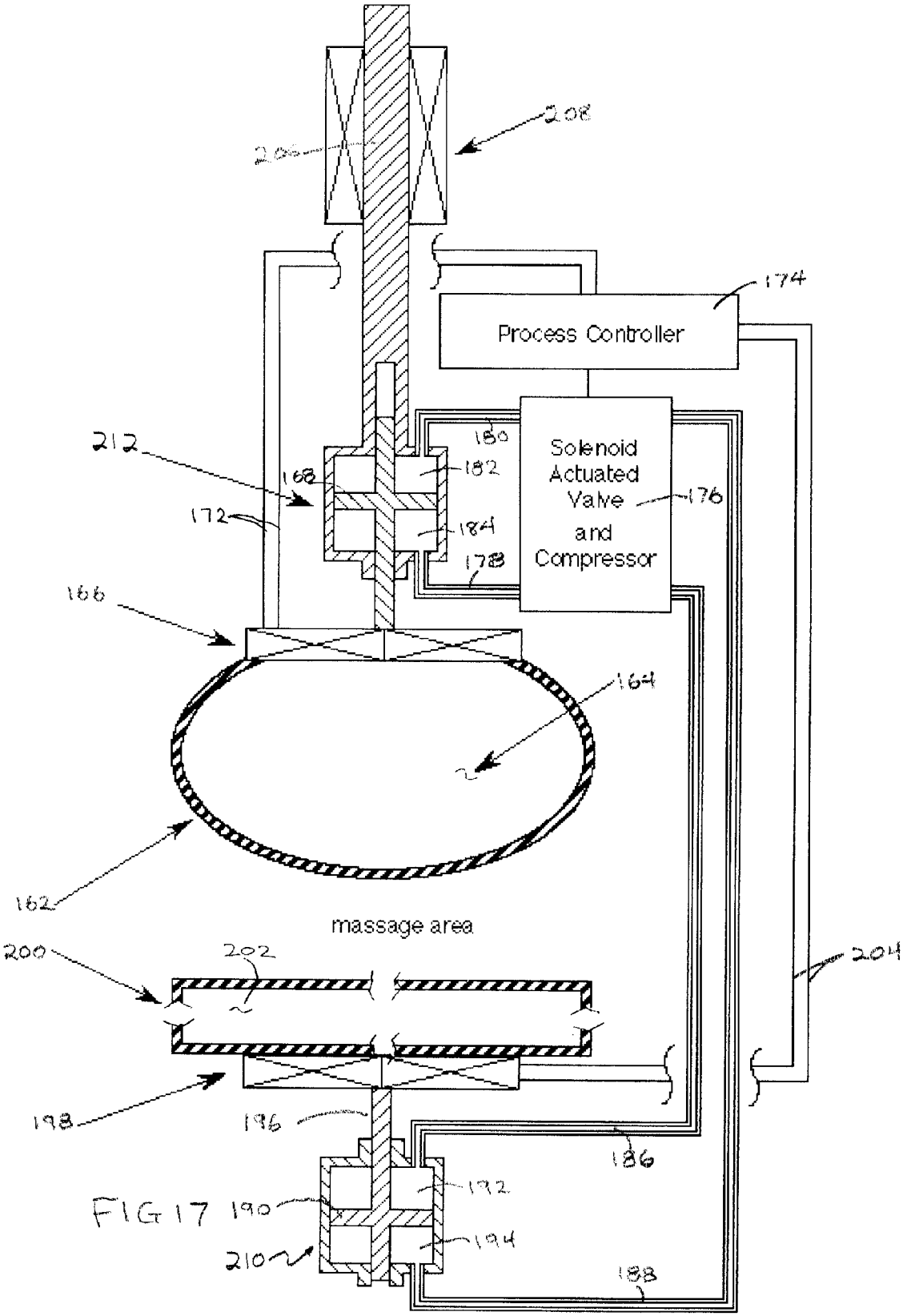
FIG. 17 illustrates a cross-sectional view through the apparatus of FIG. 16 showing the control system in schematic form.

The apparatus can also include a plurality of individually controllable and movable multiple bladders such as illustrated in FIG. 16 where individual 222 is shown lying on base bladder 200 which in this example is filled with magnetorheological fluid. A plurality of lower piston cylinders 210 is placed thereunder, supported on lower support member 220. Each lower piston cylinder 210 can include a piston 190, as seen in FIG. 17, which moves within lower piston cylinder 210 and has defined thereabove an upper piston chamber of lower piston 192 and has defined therebelow a lower piston chamber of lower piston 194. Lower piston 190 has a lower shaft 196 which extends out of lower piston cylinder 210 to lower electromagnets 198 on which rest base bladder 200 which contains magnetorheological fluid 202. Solenoid-activated valve/compressor 176 directs hydraulic fluid through third fluid line 186 and fourth fluid line 188, as needed, to move lower piston 190 up and down within lower piston cylinder 210. Whether the magnetorheological fluid above lower electromagnet 198 is made stiff in areas adjacent to lower electromagnets 198 is controlled by process controller 174 which, based on data entered into it, activates the electromagnets and directs current through power lines 204. It should be noted, as seen in FIG. 16, that base bladder 200 can be much larger than that illustrated in FIG. 17 so that it can rest on top of multiple electromagnets 198 controlled and moved by multiple lower piston cylinders 210. Individual 222 can rest on base bladder 200 and, as seen in FIG. 16, can have his head supported by head support member 224. Above individual 222 can be a plurality of multiple bladders 162, each containing magnetorheological fluid 164 and each mounted on an upper shaft 170 whose movement is controlled by upper piston 168 within upper piston cylinder 212 as hydraulic fluid is pumped into either upper piston chamber 182 or lower piston chamber 184 through second fluid line 180 and first fluid line 178, respectively, as controlled by solenoid-activated valve/compressor 176. Process controller 174 controls solenoid-activated valve/compressor 176 as to which piston cylinder will be moved and its direction and as to whether electromagnets, such as upper electromagnet 166 at the end of upper shaft 170 are to be activated through lines 172 to stiffen the magnetorheological fluid 164. Process controller 174 controls therefore the multiple selected movement direction and activation of selected piston cylinders and the activation and stiffening of selected areas of magnetorheological fluid within base bladder 200 and also within selected of the multiple bladders 162 disposed above individual 222, such multiple bladders 162 held in place by upper support member 218 which is supported on its sides by first and second side support members 214 and 216 which also support lower support member 220. The movement of the upper pistons can be such that the entire upper piston cylinder can be mounted on a shaft 206 that passes through upper support member 218 and can be moved upwards and locked in place by locking device 208 to allow room for individual 222 to be placed within the apparatus of this invention.

It should be noted that the bath or massage device of this invention, whether in its horizontal or vertical embodiments, can provide multiple therapies including sonic or ultrasound therapies by positioning appropriate transducers around the outer parts of the bath. Electrorheological fluid, magnetorheological fluid or dilatant will transmit ultrasound even when they are "activated" to a stiffer state. Other treatments also can be incorporated into the bath such as the use of piezoelectric pads placed in contact with the patient's skin.

Although the present invention has been described with reference to particular embodiments, it will be apparent to those skilled in the art that variations and modifications can be substituted therefor without departing from the principles and spirit of the invention.

I claim:

1. An apparatus for providing a selectable therapeutic treatment to a body or body part of an individual in need of such treatment, the body or body part each having a first and second side, comprising:

a fluid medium;

a plurality of fluid containment bladders;

a plurality of fluid movement devices positioned against said fluid containment bladders, each of said fluid movement devices capable of producing stimulatory activity within the fluid medium contained within said fluid containment bladders sufficient to move said medium for pressure against said individual;

means for selectively controlling the operation of said fluid movement devices in order to produce a desired pressure pattern, said pressure pattern having a wave pattern being selected from a variety of possible wave patterns to cause a specific therapeutic effect;

said fluid containment bladders including a first bladder member disposed against the first side of the body or body part and a second bladder member disposed against the second side of said body or body part, said first and second bladder members containing said fluid medium wherein said fluid medium is incapable of nondeliberate flowing out of said first and second bladder members at any angular position of said apparatus;

said fluid medium being of the type in which a thixotropic effect can be created in said pressurized zone placed under pressure by said fluid movement devices; and means for selectively actuating portions of said fluid medium to create said thixotropic effect to increase said fluid medium's viscosity and increase pressure against said body or body part.

2. The apparatus of claim 1 wherein said fluid medium is selected from the group consisting of an electrorheologic fluid, a magnetorheologic fluid, and a dilatant.

3. The apparatus of claim 1 wherein said fluid movement devices comprise a plurality of linear actuators.

4. The apparatus of claim 1 further including means to produce a magnetic field within said fluid containment bladders.

5. The apparatus of claim 1 wherein said first bladder member is comprised of a plurality of bladder members and a plurality of associated linear actuators.

6. The apparatus of claim 5 further including a plurality of discretely controlled electromagnets in association with each of said plurality of bladder members for stiffening of said magnetorheological fluid.

7. An apparatus for providing a selectable therapeutic treatment to a body or body part of an individual in need of such treatment, and wherein the individual or portion thereof is positioned within a fluid medium contained within a fluid containment chamber having a chamber wall, the improvement comprising:

a plurality of fluid movement devices positioned on said fluid containment chamber, each of said fluid movement devices capable of producing stimulatory activity within the fluid medium contained within said fluid containment chamber sufficient to move said medium for movement of fluid on said individual;

means for selectively controlling the operation of said fluid movement devices in order to produce a desired pressure wave pattern, said pressure wave pattern to create a pressurized zone within said containment chamber, said pressurized zone having a wave pattern being selected from a variety of possible wave patterns to cause a specific therapeutic effect;

said chamber wall being formed of a flexible material;

said fluid medium being of the type in which a thixotropic effect can be created in said pressurized zone placed under pressure by said fluid movement devices;

means for selectively actuating portions of said fluid medium to create said thixotropic effect to increase said fluid medium's viscosity and increase pressure in said pressurized zone against a body or body part;

a covering disposed around a body or body part, said covering preventing direct contact of a body or body part with said fluid medium, said covering including means to protect a body or body part from direct contact with electrical current and magnetic fields; and at least one electrode extending through said covering to contact a body or body part to provide direct electromuscular stimulation thereto.

* * * * *